United States Patent [19]

Reese

[11] Patent Number: 4,546,880

[45] Date of Patent: Oct. 15, 1985

[54] SHIPPABLE PACKAGE OF GLASS FIBER STRANDS AND PROCESS FOR MAKING THE PACKAGE AND CONTINUOUS STRAND MAT

[75] Inventor: Walter J. Reese, North Huntington, Pa.

[73] Assignee: PPG Industries, Inc., Pittsburgh, Pa.

[21] Appl. No.: 500,496

[22] Filed: Jun. 2, 1983

[51] Int. Cl.[4] ..... B65H 55/02

[52] U.S. Cl. ..... 206/410; 206/205; 206/415; 242/170; 242/171

[58] Field of Search ..... 206/410, 409, 415, 205, 206/210; 242/170, 171, 172

[56] References Cited

U.S. PATENT DOCUMENTS

| | | | |
|---|---|---|---|
| 1,937,468 | 11/1933 | Talbot | 206/497 |
| 2,222,039 | 11/1940 | Mahoney | 242/172 |
| 3,040,968 | 6/1962 | Long et al. | 229/87 F |
| 3,092,439 | 6/1963 | Harrison | 264/154 |
| 3,097,787 | 7/1963 | Schur | 383/94 |
| 3,188,779 | 6/1965 | Elden | 53/431 |
| 3,218,764 | 11/1965 | Deeren et al. | 206/497 |
| 3,260,358 | 7/1966 | Gottily et al. | 206/410 |
| 3,365,145 | 1/1968 | Klink et al. | 242/166 |
| 3,367,587 | 2/1968 | Klink et al. | 242/18 G |
| 3,371,877 | 3/1968 | Klink et al. | 242/18 G |
| 3,498,550 | 3/1970 | Klink et al. | 242/18 G |
| 3,547,361 | 12/1970 | Klink | 242/18 G |
| 3,638,790 | 2/1972 | Schmid et al. | 206/446 |
| 3,640,048 | 2/1972 | Zelnick et al. | 53/442 |
| 3,667,598 | 6/1972 | Zelnick et al. | 206/386 |

(List continued on next page.)

OTHER PUBLICATIONS

Modern Packaging, Encyclopedia and Planning Guide, ®1974, McGraw-Hill, Inc. Specialty Films Chart.

Properties of Plastic Resins, Modern Packaging Encyclopedia and Planning Guide, pp. 48–50.

New Developments in Packaging Films, Modern Packaging Encyclopedia, pp. 20–46.

Band-O-Matics, Great Lakes Corporation.

The Unicorn, Overwrap Equipment Corp., Fairfield, NJ.

The Unicorn Model PSW 102, Overwrap Equipment Corp., Fairfield, NJ.

Toroid, Overwrap Equipment Corp., Fairfield, NJ.

Overwrap, (Stretch packaging requirements), Fairfield, NJ.

Lan-Ringer Stretch Overwrap Systems, Lantech, Inc., Louisville, KY.

*Primary Examiner*—William T. Dixson, Jr.

*Assistant Examiner*—Brenda J. Ehrhardt

*Attorney, Agent, or Firm*—Kenneth J. Stachel

[57] ABSTRACT

A shippable package of wet strands having improved payout from the package in the production of continuous strand products is provided. The package has one or more cylindrical, layered, substantially square edged package of one or more strands, where the strands have a coating on the fibers making up the strands of an aqueous composition having a film forming material. The aqueous composition has an amount of water in the range of about 70 to around 99 weight percent of the composition. The amount of moisture of the package of strands is at least about 3 weight percent of the package. In addition, the shippable package has a sealed covering of substantially water impervious material to age the package of strand or strands for at least about two weeks at ambient temperatures. The process of producing the package involves drawing the fibers, treating the fibers with the aqueous treating composition having the film forming material, gathering the fibers into one or more than one strand, winding the strands into the package of one or more strands, covering one or more packages of strand or strands with a substantially water impervious material to completely seal the package of strand and aging the covered package of strands for at least about two weeks at ambient temperatures. The aged package of strands can be used in producing continuous strand products, where the covering of water impervious material is removed sufficiently to allow the payout of the aged strands into continuous strand product. The payout of the aged sized strand or strands is improved because of the aging in the moist environment.

25 Claims, 4 Drawing Figures

U.S. PATENT DOCUMENTS

| | | | |
|---|---|---|---|
| 3,731,792 | 5/1973 | Rolston | 206/389 |
| 3,747,746 | 7/1973 | Newman et al. | 206/409 |
| 3,850,294 | 11/1974 | Philipps et al. | 206/205 |
| 3,915,301 | 10/1975 | Gray et al. | 206/409 |
| 3,945,493 | 3/1976 | Cardinal | 206/386 |
| 3,948,148 | 4/1976 | Bringer | 91/461 |
| 3,983,997 | 10/1976 | Warshaw | 206/389 |
| 3,998,404 | 12/1976 | Reese | 242/158.3 |
| 4,147,253 | 4/1979 | Brook et al. | 206/410 |
| 4,158,557 | 6/1979 | Drummond | 65/2 |
| 4,167,252 | 11/1979 | Klink et al. | 242/18 G |
| 4,220,295 | 9/1980 | Green et al. | 242/170 |
| 4,244,533 | 1/1981 | Reese | 242/18 R |
| 4,277,531 | 7/1981 | Picone | 428/228 |
| 4,300,734 | 11/1981 | Green et al. | 242/170 |
| 4,322,041 | 3/1982 | Schuller et al. | 242/42 |
| 4,437,567 | 3/1984 | Jeng | 206/210 |

SHIPPABLE PACKAGE OF GLASS FIBER STRANDS AND PROCESS FOR MAKING THE PACKAGE AND CONTINUOUS STRAND MAT

The present invention is directed to a package of a plurality of mineral fiber strands which can be shipped to remote locations from the location of producing the package and the process for producing such a package and the use of one or more of the packages of mineral fiber strands to produce continuous strand mat.

Strands of mineral fibers such as glass fiber strands generally are produced at fast processing speeds from a source of fiberizable molten mineral material like molten glass batch material and the strands are collected in various forms. In the case of glass fibers, myriad glass fibers in the order of from around 200 to greater than 2,000 are attenuated from small orifices in a bushing of a glass batch melting furnace from molten glass batch material. The fibers are attenuated by a winder, which collects the glass fibers usually in the form of one or more strands into a wound layer on layer package. As the fibers cool after being pulled from the orifices in a bushing, a chemical treatment known as a sizing composition is applied to the glass fibers. The glass fibers are then gathered into one or more strands and wound onto the winder.

In the formation of glass fibers, the sizing composition plays an important role. The role that is performed by the size is to provide lubrication and protection of the filaments and the strand in order to prevent interfilament abrasion during the wet conditions of fiber forming and also during processing conditions for producing products from the strands. When the strands are to reinforce polymeric materials to form fiber reinforced polymers (FRP), additional components must be present in the sizing composition. These additional components assist in the performance of an additional role played by the sizing composition. The second role is to adequately couple the glass fiber strands to the polymeric matrix so that stress that is applied to the FRP article will be transferred from the matrix polymer to the reinforcement. In performing this role, the sizing composition must also provide compatibility of the glass fibers to the polymer matrix in which the fibers are used as reinforcement. The components for this second role are usually coupling agents and film forming polymers.

The sized glass fiber strands that are used as continuous strands for reinforcing polymeric materials to produce FRP products can be provided as a roving. Roving can be formed by mounting on a creel or support a plurality of glass fiber forming packages, which are produced during formation of the glass fibers and, where these packages have tapered ends. The strands from each forming package are gathered in parallel to form the rope or roving. This braided rope or roving is wound on a forming drum to collect the roving. The roving package is a cylindrical package with the parallel glass fiber strands wound onto the package. The package has two flat annular ends with neat or square edges. Another method of producing a multistrand cylindrical package having neat or square edges is by directly winding such a package during formation of the glass fibers. Such a method avoids the rewinding of a roving from a plurality of forming packages, and allows for the economic benefit of producing the multistrand package directly during fiber formation. This directly wound cylindrical package has flat annular surfaces and at least nearly square edges on both ends of the package. The number of strands in a directly wound multistrand package can vary from about 2 to about 20. Examples of direct wound roving packages are found in "Manufacturing Technology of Continuous Glass Fibers", by K. L. Lowenstein, Elsevior Scientific Publishing Company, Amsterdam, The Netherlands, 1973 at pages 261–263 and in U.S. Pat. Nos. 3,365,145; 3,371,877 and 4,322,041.

In the production of roving packages, the lay of the strands in the successive layers making up the package is important to achieve the desired dimensions of the package, that is, the square or neat edges and the flat annular surfaces. Also, the lay of the strands is important in roving packages in removing the strands from a roving package to use strands in various applications, such as the formation of continuous strand mat. The ability to obtain the same number of distinct strands out of a wound roving package as were placed in the wound roving package during processing is an important parameter to the efficiency of further process operations. This ability is referred to as the "splitting efficiency", as defined in the book "The Manufacturing Technology of Continuous Glass Fibers" at pages 181 and 182. Split efficiency is the number of substrands formed expressed as a percentage of the number that should have been formed. The determination involves the counting of the number of substrands in a sample of known weight. The splitting efficiency can be found by the formula "$NLT/10^4 ws$ %". In this formula, N is the number of substrands formed in a sample of a specific weight, L is the chopping length, T is the tex of the whole strand, w is the weight and s is the intended split of the strand.

The continuous strands of glass fibers from roving packages are used to reinforce polymeric materials as chopped or continuous strand. One form of continuous strand that can be used to reinforce polymeric materials is a continuous strand mat. The continuous strand mat can be produced from roving packages, where the numerous strands coming from one package can be combined with numerous strands coming from one or more other roving packages and these continuous strands are deposited on a moving conveyor belt. The continuous strands coming from the roving package should have adequate payout and a good split efficiency of the strands being removed from the roving package.

Strands that are intended for use in reinforcing polymeric materials having present the dried residue of the sizing composition may have reduced split efficiency and payout of the strands from the roving package. The cause of such a reduction would be the fact that the sizing composition has set on the dried glass fibers and strands so that any tackiness between the strands would tend to keep the strands from paying out and splitting efficiently. Also, in depositing the strands, which have a dried set sizing composition, into a continuous strand mat, the sizing composition coating the glass fibers and strands may fracture and cause points of weakness in the glass fiber strand mat. Another problem resulting from the setting of the sizing composition on the glass fibers in the production of a continuous strand mat is the deleterious effects on the loft of the mat. The dried residue or set residue of the sizing composition on the glass fibers and strands provides the glass fiber strand with some elasticity. This elasticity can cause problems if the loft of the mat is too high. When such a mat is combined with a thermoplastic polymeric matrix, and when the glass fiber thermoplastic polymer matrix is heated for molding, some of the loft originally exhibited by the lofty glass fiber mat may return due to the softening of the resin at the elevated temperatures. As the resin softens, the glass fibers, which are under compression, tend to relax and spring back to their original position, i.e., as they were in the lofty glass mat. If this loft is too great, there will be nonuniform heating of the polymer matrix having the glass fiber strand mat so that the surfaces of the polymer matrix become very hot while, the center remains cool due to the insulation effect of the air and the glass fibers in the lofty continuous glass fiber strand mat. This nonuniform heating could lead to scorching of the surfaces of the polymeric matrix having the lofty mat, while the center of the mat does not heat adequately for stamping.

The numerous problems associated with the use of dried glass fiber strands having a set sizing composition present on the fibers and the strands are reduced, when the continuous glass fiber strand mat is prepared at the same facility, where the glass fiber strand is produced. In such an operation, the feed stock of glass fiber strands may not be dried to completion so that moisture is present on the strands that are used to produce the continuous glass fiber strand mat.

To prepare continuous glass fiber strand mat at a location remote from the location, where the continuous glass fiber strands are prepared, the art requires a suitable package for shipping glass fiber strand and preferably roving to retard complete drying of the strands so as not to experience the concommitant problems associated with forming continuous glass fiber strand mat with dried glass fiber strand. Such a package would have to endure conditions of shipment which may range from sitting in a hot warehouse in the southern portion of the United States in the dog days of summer to being stored in the hull of a ship during transportation across the chilly North Atlantic in the middle of winter.

It is an object of the present invention to produce a shippable package of glass fiber strands having one or more strands per package having a sizing composition with at least a film forming material.

It is a further additional object of the present invention to provide a process for producing a shippable package of glass fiber strand having one or more strands per package, where the fibers and strands have a size of at least a film forming polymeric material.

It is a further additional object of the present invention to provide a process of using a package of glass fiber strands having one or more strands per package, where the fibers and strands have a sizing composition of at least a film forming polymeric material and the package is a cylindrical package having flat annular ends and square edges and having good split efficiency and good payout to produce a continuous strand mat.

SUMMARY OF THE INVENTION

Accordingly, the aforementioned objects and other objects eclectically gleaned from the following disclosure are achieved by the product, process and use of the present invention.

The present invention includes a shippable, cylindrical package of one or more strands of sized mineral fibers, where the strand has good payout from the package, a process for producing the package, and a process for using the package in producing continuous strand mat.

The shippable package is a cylindrical package with substantially square edges and two nearly flat annular surfaces having one or more strands of mineral fibers sized with an aqueous treating composition having a film forming material, where the one or more strands are wound in a layer on layer arrangement. The cylindrical package is sealed inside a substantially water impervious covering to age the package for at least two weeks at ambient temperatures. The ambient temperatures generally can vary from about 50° F. (10° C.) to about 90° F. (32° C.). The one or more strands are wound into the package in a direct winding operation during the formation of the mineral fibers, and where more than one strand is in each layer, they can be in side-by-side arrangement or in a criss-crossing arrangement. The covering is substantially water impervious, so that after aging, the strands have at least 2 weight percent moisture. Nonexclusive examples of substantially water impervious coverings include polymeric films having a water vapor transmittance in grams/ 24 hours / 1 square meter at 100° F. (37.78° C.) at 90% relative humidity according to American Society of Testing Materials (ASTM) test E96, Method E1 of less than 20 for a one mil thickness.

The process of producing the cylindrical package of direct wound strand or strands involves drawing a plurality of the mineral fibers at a high speed from a molten source, treating the glass fibers with an aqueous treating composition, collecting the treated glass fibers into one or more strands, winding the one or more strands into a cylindrical package having nearly square edges and two flat annular surfaces, placing one or more of the packages in a covering that is substantially impervious to water, sealing the covering to completely surround the one or more packages, aging the sealed packages for around at least two weeks at ambient temperatures ranging from about 50° F. to about 90° F. (about 10° C. to about 32° C.) The aqueous treating composition has at least a film forming material, which can form a film either on evaporation or by chemical reaction of various components, and the composition also has a water content of about 70 to around 99 weight percent of the aqueous treating composition. When more than one strand is wound into the cylindrical package, the winding is performed in such a manner as to provide for drawing the strands out of the package with a split efficiency of around 70 to around 100 percent. The one or more strands wound into the package have a moisture content of at least 3 weight percent based on the weight of the strand. During aging in the covering, the moisture level of the strand should not decrease below 2 weight percent of the strand.

One or more packages of one or more strands with improved payout of the strand or strands from the package can be used in producing continuous glass fiber strand mat. Such a process involves removing the one or more strands with at least 2 weight percent moisture from a plurality of aged packages and distributing the strands onto a moving conveyor in a reciprocating fashion to form the continuous strand mat. Subsequently, the continuous strand mat can be needled to form a needled glass fiber strand mat. The continuous strand mat and needled strand mat can be used to reinforce thermoplastic and thermosetting polymeric materials to produce FRP products.

DETAILED DESCRIPTION OF THE DRAWINGS AND PREFERRED EMBODIMENT

The package of mineral fibers, usually glass fibers, hereinafter referred to as glass fibers, process for producing the package of glass fibers and process of using the glass fibers of the present invention is based upon a synergistic cooperation between the aqueous sizing composition having a film forming material present on the fibers with an amount of moisture of at least around 3 weight percent and the aging of the sized strand in a moisture impervious cover for a sufficient time at a sufficient temperature.

It is believed without limiting the scope of the invention that the functions of the film forming material of protecting the glass fibers to assist in adhering the fibers into strands and to make the fibers compatible with any polymeric matrix in which the sized glass fibers are used as reinforcement are enhanced, when the package of treated strand or strands are aged in a moist environment. The moist environment is that produced in a substantially water impervious cover that is sealed around the package of one or more wet glass fiber strands. The wetness of the glass fiber strands is a moisture content of at least around 3 weight percent based on the weight of the strand. The enhancement of the functions of the film forming materials allow for improved payout of the glass fiber strands from the cylindrical package in both an internal pull from the center of the package and an external pull from the outer surfaces of the package. The functions of the film forming material are enhanced to such a degree that the amount present on the glass fibers can be reduced from the amount typically used. It is also believed without limiting the invention that the synergistic effect is engendered by an equilibrium, which occurs during aging, of the moisture on the glass fibers and the film forming material and possibly other components on the fibers from the amounts of the components in the aqueous treating composition. The amounts are conveniently expressed in an amount of the coating lost on ignition of the coated glass fiber strand. The aging of the strand or strands in the moist environment appear to allow the film forming material to set to some degree especially when a lubricant and/or plasticizer is also present. This degree of setting occurs more uniformly in the package of strand or strands without a great degree of migration from the inside of the package to the outside of the package. This assists in providing for improved payout of the strand or strands from the aged packages.

Figure 1:
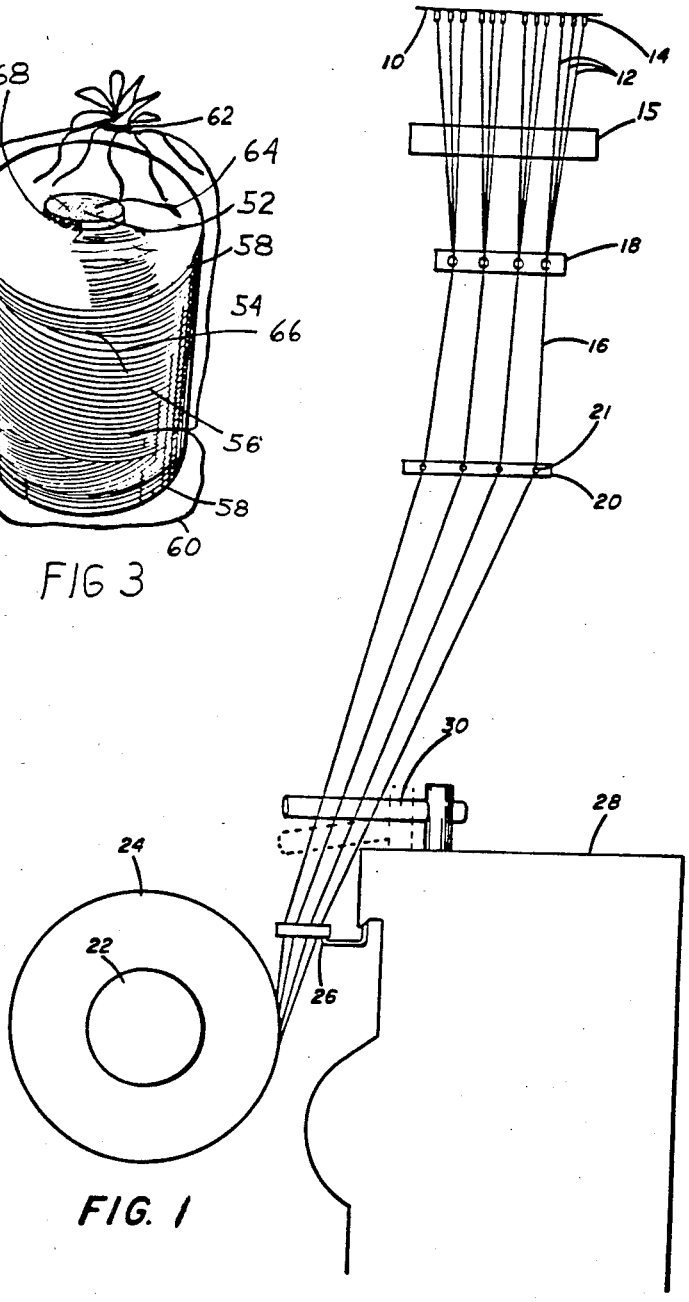
FIG. 1 is a schematic representation of the process for producing the shippable package of one or more wet strands of sized mineral fibers of the present invention.

Referring initially to FIG. 1, there is illustrated an apparatus and method of forming a cylindrical package with nearly square edges of one or more strands. Preferably, the apparatus and method of FIG. 1 are used to produce a multistrand package, although a single strand package can also be made. For producing a single strand package, the apparatus and method of U.S. Pat. Nos. 3,998,404; 3,367,587 and 3,365,145, all hereby incorporated by reference, can be used. In FIG. 1, there is illustrated a fiber forming apparatus generally designated as numeral 10 from which glass fibers, numeral 12, are drawn or attenuated from cones of heat softened glass suspended from tips, 14, in the openings of the bottom of the bushing 10.

The glass fibers can be formed from any known fiberizable glass material. Examples of such glass material include "E" glass and "621" glass and environmentally acceptable derivatives thereof known to those skilled in the art. The fibers formed can have any fiber diameter ranging from the submicron range to the macro range of $12.5\times10^{-4}$ in. $\pm0.025\times10^{-4}$ in. or more.

The bushing may, for example, have 40 rows with 25 tips in each row so that about 2,000 fibers can be simultaneously drawn from the tips in the bushing 10. From each of the rows, around 50 to 1,000 fibers are gathered and formed into one or more than one bundle of fibers each designated by numeral 16. A plurality of bundles of fibers are formed by gathering the filaments 12 in gathering shoe 18, whereas a single strand would be gathered from the fibers in a gathering shoe with only one collection site. The gathering shoe can be any device known to those skilled in the art for gathering filaments into one or more bundles of filaments or into strands, a nonexclusive example of which is a rotatable gathering shoe, which is usually made of graphite. Another nonexclusive example is a stationary shoe or comb, which can be made of graphite or cotton and phenolic resin laminate, such as micarta or reinforced phenolic laminate.

Before the fibers are gathered into one or more bundles of fibers, the fibers are passed in contact with an applicating device, 15, to supply the fibers with a coating of chemical material over a substantial portion of their surfaces. The coating has water as a carrier in an amount of about 70 to around 99 weight percent of the treating composition and has one or more aqueous soluble, emulsifiable or dispersible film forming materials. In addition, the treating composition can have one or more lubricants, plasticizers, surfactants, coupling agents and the like known by those skilled in the art.

The film forming materials can form a film upon evaporation of some of the carrier or upon chemical reaction with additional components of the aqueous treating composition, for example, during the process of applying the composition to the fibers and winding the bundles of fibers into a package. Nonexclusive examples of film forming materials include: naturally occurring materials, for example, starches, such as corn starch, potato starch, tapioca starch and sago flour; gums, such as gum arabic, gum tragacanth and gum karay; glues, such as gelatin and animal glues; casein; glucose, cellulosic materials such as carboxymethyl cellulose, hydroxyethyl cellulose, methyl cellulose; oxyethylated stearates; and synthetic resins, such as ureaformaldehyde polymers, melamineformaldehyde polymers, acetoneformaldehyde polymers, phenol-formaldehyde polymers; alkyd resins such as glyceryl-phthalic anhydride reaction products; polyamides, saturated and unsaturated polyesters, hydrocarbon-siloxane resins, epoxy resins; vinyl resins such as homopolymers and copolymers of ethylene, propylene, styrene, isobutylene, butadiene, acrylonitrile, vinyl chloride, vinyl pyrrolidone, vinylidene chloride, vinyl acetate, vinyl alcohol acrylic acid and ester thereof, methacrylic acid and esters thereof, polyvinyl acetate, polyvinyl pyrrolidone, polyacrylate and polymethacrylate esters, polyacrylamide, polymethacrylamide, saturated polyesters, unsaturated polyesters, epoxy resins, melaine resins, phenolic resins and copolymers and mixtures of these materials. The choice of a particular film-former depends upon a number of factors including the form in which the glass will be used (i.e., continuous strand, chopped strand, mat, woven roving, etc.) and the resin system in which the glass is to serve as reinforcement. Polyvinyl acetate is commonly used as the film-former in systems, where the resin to be reinforced is unsaturated polyester, although the use of polyester resins as the film-former in these systems is growing in importance. Glass to be used in epoxy or phenolic resin systems commonly uses as the film-former a saturated polyester resin modified with polyvinyl pyrrolidone although epoxy resins are also used in these systems. On the other hand, where the treated glass fibers are to be used in producing glass yarns for reinforcing polymers, such film-formers as starches, casein and the like are used.

Along with the film forming material, the one or more coupling agents, lubricants, surfactants, emulsifiers, plasticizers and the like that may be used alone or in combination in the aqueous sizing composition are those known by those skilled in the art to be capable of use in aqueous treating compositions for glass fibers. Preferably, the components that are present in the aqueous treating composition are the film forming material, lubricant and a plasticizer. Most preferably, the aqueous treating composition that is used to treat the glass fibers is a peroxide-containing sizing composition like that disclosed in U.S. Pat. No. 3,849,148, which is hereby incorporated by reference. Another example of aqueous treating compositions that can be used are those disclosed in U.S. Pat. No. 3,621,092, which is hereby incorporated by reference.

Although FIG. 1 indicates that four bundles or strands, hereinafter referred to as strands, can be formed from the illustrated number of fibers, the present invention is not restricted to operation with four strands, but is particularly useful for simultaneous winding of greater numbers of strands, for example, 12 strands or even more. The number of strands generally varies from 2 to more than 12, and more preferably from about 2 to about 8.

The strands, 16, from the gathering or splitting device 18 travel downwardly. In a double level operation, the strands travel along divergent paths established by bar 20, which has a plurality of guides 21 to accommodate the number of strands so as to direct the strands further downward to converge at the winder after passing through the curved traversing device 26 for disposition onto a rotating winder, mandrel or collet 22. Bar 20 is needed in a double level operation because the glass fibers travel a distance from the bushing to the point of being wound onto a package, which is the distance of two operating floors (not shown). In the double level operation, the distance between the bushing nozzles and the axis of the winder is generally around 3.5 to 4 meters. The bar 20 separates the strands from each other a sufficient distance so that, when the strands pass through the curved traversing device, the converging paths of the strands still allow for some separation at the curved traversing device. In a single level operation, where the distance between the nozzles of the bushing and the axis of the winder is around 2 to about 2.5 meters, the bar 20 is not necessary because the converging paths of travel of the strands usually naturally allows for such a separation of the strands at the curved traversing device. In the double level operation, if the strands are not adequately separated from each other at the traversing guide 26, the holes or hooks 21 in bar 20 are separated further from each other to cause the strands to diverge to a greater extent. This further divergence of strands increases the length of the point of convergence downwardly away from bar 20, and permits an increase in the separation of the strands at the traversing guide 26. If less separation of the strands at the traversing guide 26 is desired, the holes or hooks 21 that contain the strands are moved closer to each other. Generally, the strands on either end of bar 20 can be moved outwardly from the center of the bar to a distance, where the angle formed in the strand between the ingressing strand segment and the egressing strand segment to bar 20 can be up to around 90°.

As the strands travel downwardly in converging paths to winder 22, which provides the force of attenuation for the fibers from bushing 10 and which also winds the strands into a package 24, the strands are guided in traversing manner by curved traversing guide 26. The traversing guide can be any device to guide the strands onto the package as individual strands rather than as a group of strands for a majority of each layer in the package. The traversing guide can be a comb as in U.S. Pat. No. 3,371,877 (Klink et al.) or a V-shaped guide or notched guide as disclosed in my copending patent applications Ser. Nos. 456,886, filed Jan. 10, 1983 and 461,331, filed Jan. 27, 1983, respectively, all of which are hereby incorporated by reference. The winder may be any conventional winder known to those skilled in the art. The winder is rotated generally by a winder motor (not shown) in a clockwise direction. The traversing guide is movably attached to reciprocating means 28, which may be any reciprocating means with a conventional drive means and means for converting rotational motion to linear reciprocating motion known to those skilled in the art, for example, like that disclosed in U.S. Pat. No. 3,998,404 (Reese) hereby incorporated by reference. The operation of the reciprocating means 28 causes the traversing guide 28 to move the strand or converging strands back and forth in a direction parallel to the axis of rotation of the winder so that the strand or strands are deposited on the winder to form a layer across the peripheral surface of the winder. For a plurality of strands, as the traversing guide comes to the end of each stroke and the reciprocating means reverses, the strands hit contact means 30 shown in FIG. 1 or a contact means located at the opposite end of the stroke not shown in FIG. 1 but shown in FIG. 2.

The winder and reciprocating means generally interact so that one or both move away from each other as the layers of strand or strands build up on the winder. This movement precludes any substantial contact between the traversing guide 26 and the outer layer of package 24. Any conventional mechanism known to those skilled in the art for effecting this movement can be used. For example, the mechanism in the reciprocating device of U.S. Pat. No. 3,998,404, hereby incorporated by reference, may be used or a movable winder and reciprocating means used in conjunction with an air sensing device like that of U.S. Pat. No. 4,244,533, hereby incorporated by reference, may be utilized. Also a spring sensing mechanism associated with the traversing guide and reciprocating means as known by those skilled in the art may be used to move the traversing guide and the reciprocating means away from the rotating winder. A particularly suitable traversing guide and apparatus for producing multiple strand packages are those described in my copending U.S. patent application Ser. No. 456,886, filed Jan. 10, 1983, which is shown more fully in FIG. 2.

Figure 2:
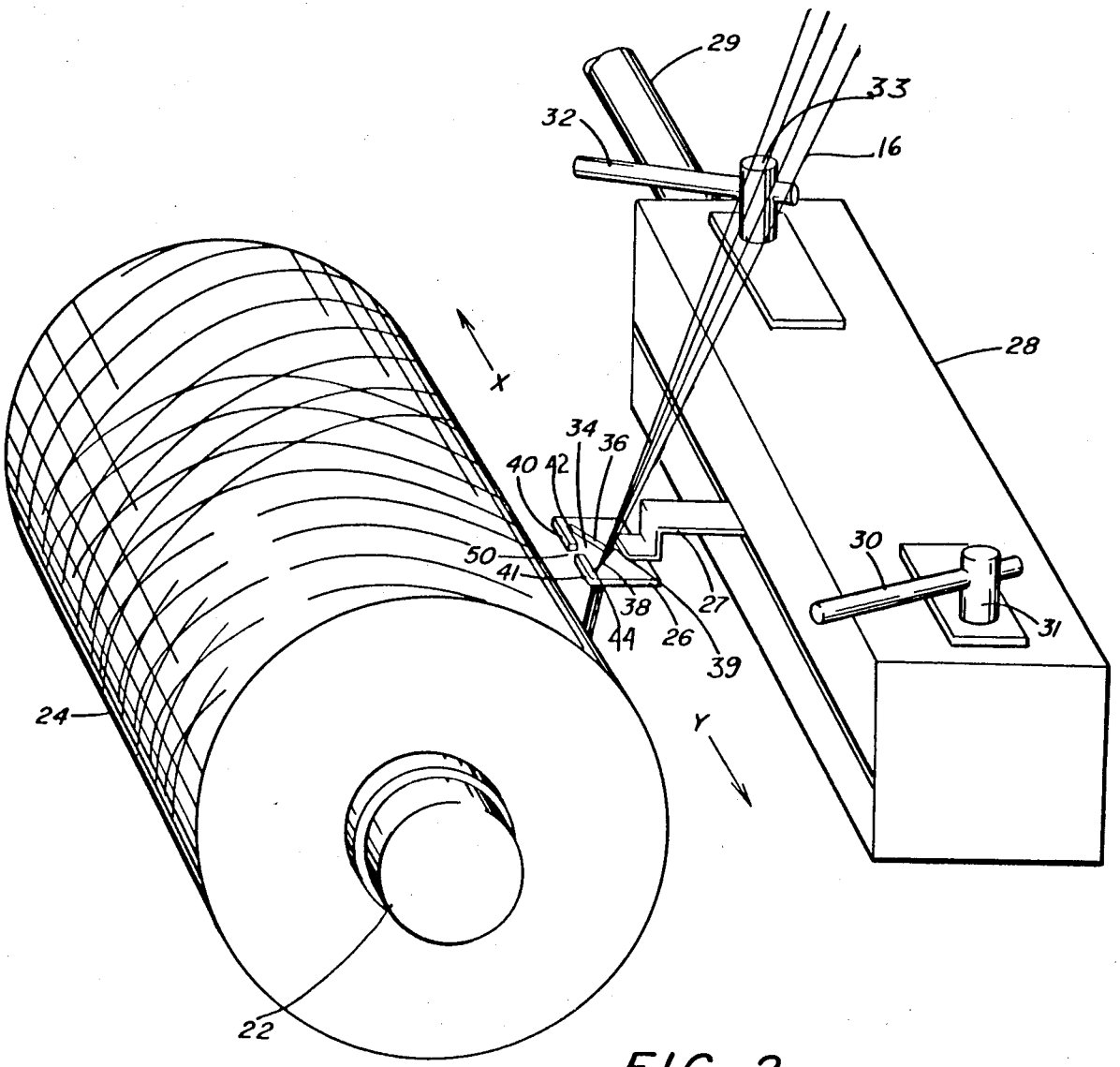
FIG. 2 is an enlarged, isometric view of a winder, reciprocating means and traversing guide for a process of producing a cylindrical, direct wound roving package.

Turning now to FIG. 2, there is shown an isometric side view of winder 22, package 24, traversing guide 26, reciprocating means 28 and contacting means 30 and 32. The reciprocating means 28 holds the traversing guide 26 in a near horizontal position and preferably a horizontal position so that the plurality of strands 16 can approach the traversing guide from a direction varying from an acute angle up to a perpendicular angle in relation to the guide. Generally, the geometry of the downwardly traveling filaments and strands in relation to the winder can be any geometry known to those skilled in the art. The fiber forming apparatus, gathering means, traversing guide, reciprocating means, and winder along with any applicating means and diverter means are all positioned and supported in relation to each other to obtain the proper filament and strand geometry. For example, the winder can be directly under the bushing or not directly under the bushing, but off to one side including in front of or behind the downward projections of the perimeter of the bushing.

As shown in FIG. 2, the curved traversing guide in a near horizontal position to the tongue 27 of reciprocating means 28 is reciprocated parallel to the axis of rotation of winder 22. The reciprocating means 28 as shown in FIG. 2 is stationary so that the winder 22 is adapted for movement away from the reciprocating means 28, as the package 24 is built up on winder 22. The reciprocating means 28 as mentioned above can be like that of U.S. Pat. No. 3,998,404 used in conjunction with the air sensing device of U.S. Pat. No. 4,244,533 (not shown). The tongue 27 is connected through appropriate linkage to rotating shaft 29 so that the rotational motion of shaft 29 is converted into the linear reciprocating movement of tongue 27.

On top of reciprocating means 28 are located attachment means 31 and 33 that support contacting means 30 and 32 respectively. These contacting means can be positioned anywhere on the reciprocating means or on a separate support means so the contacting means are above or below the reciprocating curved traversing guide so that the traversing guide can pass partially under or over the contacting means. Preferably, the contacting means are located above the reciprocating curved traversing guide. Also the contacting means are located so that one is adjacent each end region of package 24. The contacting means need not be directly adjacent the end regions of package 24, but they should not be located beyond the position that is adjacent the end regions. The contact means 30 and 32 can be located at a position somewhat short of the end regions of the package 24. Indeed the contacting means 30 and 32 should be movable so that, if desired, they can intentionally be located short of the end regions of the package 24. The location of the contacting means somewhat short of the position directly adjacent the ends of package 24 will be dictated by the type of strands being wound onto the winder. Generally, when the strands are tacky, the contacting means 30 and 32 should be at a position adjacent the edges or end regions of package 24 or slightly beyond the edges. Less tacky or nontacky strands will require the contacting means to be at a position adjacent a position on the package that is not so close to the edges of the package.

The contacting means may be constructed of any suitable material. Particularly useful materials are glass fiber reinforced resins and unreinforced resins such as polypropylene, nylon, polyester resins, epoxy resins, polycarbonate resins and the like. Also materials may be used such as hard rubber, micarta, steel, brass and graphite. The shape of the contacting means is generally a rod but any other shape may be used as long as it does not cause any abrasion to the strands.

The position of the traversing guide 26 can be some distance from winder 22, but is always slightly elevated from the point of contact between the strands and the winder. The curved traversing guide is in a nearly horizontal position that can vary about 45 degrees above the horizontal line to 45 degrees below the horizontal line. The distance the guide is away from the winder and the surface of the package being built during winding is that distance which will not result in the guide excesssively rubbing the peripheral layer of the completed package, preferably about 2 to 20 mm.

As shown in FIG. 2, the traversing guide has a preferred triangular-shaped containment area 34 formed by two angularly opposing sides 36 and 38 and extensions 40 and 41. The containment area 34 could be shaped as a semicircle or semielipse or any similarly truncated circles or elipses. These angularly opposing sides lie in angularly opposing vertical planes, where the vertical planes and angularly opposing sides form an angle ranging from greater than 0° to less than 180°. Preferably the angle is about 20° to about 100° and most preferably it is from about 35° to about 80°. The traverse guide 26 also has two extensions 40 and 41, one from each opposing side as they diverge at distal points from the angle or corner formed by the angularly opposing sides so that the extensions partially subtend said angle or corner. The extension 40 and 41 and opposing side to which the extension is attached 36 and 38, respectively, form corners 42 and 44 respectively. The two extensions can lie anywhere in a vertical plane which subtends the angle formed by the two angularly opposing sides 36 and 38 so that the corners 42 and 44 formed between the extensions 40 and 41 and the respective angularly opposing sides 36 and 38 vary in degree value from greater than 0° to around 135° and preferably from about 30° to about 90° and most preferably from about 45° to about 75°. The corners 42 and 44 can be rounded corners, where projections of the angularly opposing sides meeting the extensions form the aforementioned angles. The extensions 40 and 41 do not meet each other and only partially subtend the angle formed by the angularly opposing sides 36 and 38 because an opening exists between the two extensions 40 and 41 having sufficient dimensions to allow the strands to be placed into the containment area 34 formed by the two angularly opposing sides and two extensions. The opening is a sufficient distance from each corner 42 and 44 to reduce the risk of the strands leaving the triangular-shaped containment area 34 during traversing.

The curved traversing guide 26 in a near horizontal position from or with tongue 27 traverses along the linear length of the winder parallel to the axis of rotation of the winder. In the center portion of each traverse stroke, the strands 16 are within the containment area 34 of curved traversing guide 26. The opposing side on which the strands 16 are in spaced apart relation is the nonleading opposing side farthest away from the direction of travel of the traversing guide 26 in its traversing stroke. Here a traversing stroke is one pass along the linear length of the winder parallel to the axis of rotation. The spaced apart strands can be positioned along the nonleading opposing side 38 from corner 39 to corner 42 or anywhere in between when, as shown in FIG. 2, the traversing guide 26 travels in the "x" direction. In this mode, the strands are disposed onto the winder in essentially noncrossing, side-by-side relation to each other. As the curved traversing guide 26 approaches the end of its traversing stroke, guide 26 partially passes over or under a contact means, here contact means 32. As the guide 26 passes by the contact means 32, the contact means 32 contacts the strands and moves all of them by this contact to corner 44. In this mode, the gathered strands are disposed onto the winder as a group of strands. At or around this point, the reciprocating means 28 reverses the direction of tongue 27 and traversing guide 26 to move in the "y" direction. After passing by contact means 32 in the "y" direction, the strands are no longer being contacted by the contact means and move into spaced apart relation along the nonleading opposing side. In the "y" direction of travel, the nonleading opposing side is side 36. Once again, the disposition of the strands onto the winder is in essentially noncrossing, side-by-side relation. This pattern of disposition continues until the curved traversing guide 26 approaches the opposite end of the winder.

On approaching the opposite end of the winder, the curved traversing guide 26 partially passes over or under contact means 30. The contact means 30 contacts the strands somewhere above or below traversing guide 26 and moves the strands into corner 42 of guide 26 as a result of this contacting. Once again in this mode, the gathered strands are disposed on the winder as a group of strands. At or around this point, where the strands are gathered into corner 42, the reciprocating means 28 reverses the direction of travel of tongue 27 and curved traversing guide 26 to the opposite direction. As the guide 26 passes by contact means 30, the strands no longer contact the contact means 30 and become positioned in noncrossing, side-by-side, spaced apart relation along the nonleading opposing side 38. Once again, the strands are disposed onto the winder in essentially noncrossing, side-by-side, spaced apart orientation.

From one point of reversal to the other by the reciprocating means 28, the strands disposed on the winder constitute a layer. As the curved traversing guide makes a plurality of strokes from reversal to reversal, layer upon layer of strands build up on the winder 22. Since the strands are consistently contacting the contacting means 30 and 32, where these contacting means are in the same location, the layers of strands built up on the winder have straight, nearly square edges. These edges result from the grouping of strands being deposited at both ends of each layer on the winder.

The reciprocating means 28 has some deceleration before reversal and some acceleration after reversal. These effects occur to some degree, while the strands are contacting one or the other of the contacting means and while the winder is rotating. The result is that the group of strands is not only disposed in a layer at the exact end of the layer, but to a degree before the end of the layer and after the end of the layer in the reverse direction. A nonexclusive example of the length of grouped strands disposed in a layer around each end is around 4 to around 8 inches (100 mm to 205 mm) of grouped strands approaching and leaving each end.

The ends of layers of strands may not be exactly the ends of the winder. The ends of the winder may and preferably do extend beyond the ends of the layers of strands that make up a wound package of a plurality of strands. When this wound package is removed from the winder by conventional techniques, the plurality of strands can be removed from the package as distinct strands with about 99 to slightly less than 100% split efficiency.

The winder of FIG. 1 and FIG. 2 is operated at a speed sufficient to achieve the desired fiber diameter and throughput from the bushing. Generally, the speed is around 1,000 to around 6,000 or more feet per minute. Adequate tensioning of the fibers for their formation from the bushing of the glass melting furnace can be achieved by any method known to those skilled in the art. The amount of aqueous sizing composition picked up by the glass fibers as they contact the aqueous size applicating device is controlled by the speed of the applicating device. This speed is sufficient to result in a pick-up of the aqueous sizing composition of an amount in the range of about 0.1 to about 3 and preferably about 0.3 to about 2.5 weight percent loss on ignition (LOI). The loss on ignition test is a standard industrial test for determining the amount of coating on a textile strand by burning the coating off the strand and expressing the amount of material removed as a percentage of the weight of the strand with the coating.

The amount of moisture on the fibers and strand or strands is controlled by the amount of water in the aqueous sizing composition which ranges from about 70 to around 99 weight percent of the composition. Also the amount of water sprayed onto the fibers for cooling contributes to the control of the moisture content of the strands. Some of the moisture present on the strand or strands that are wound will be flung off the strands by the centrifugal force of the winder. The amount of moisture picked up by the glass fibers is sufficient to result in an amount of moisture of at least around 3 weight percent based on the weight of the strand for the strand or strands in the wound package. The amount of moisture on the strand in the package can generally be any amount at least 3 weight percent so that the aging process produces a good interaction between the moisture and the sizing composition to result in the aged glass fiber strands having improved payout from the multistrand package. It is preferred that the moisture content be in the range of at least about 3 to about 12 weight percent because too much moisture present on the strands may cause sloughing problems, when the strands are removed from a single strand or multistrand package.

Figure 3:
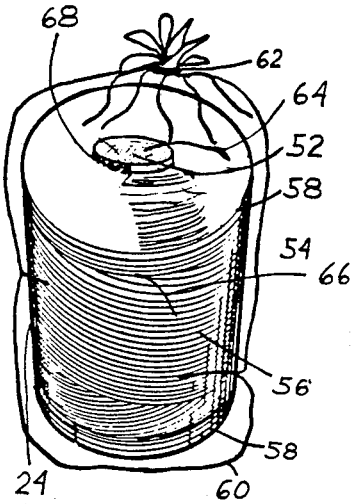
FIG. 3 is an isometric view of the complete shippable package of one or more wet strands of sized mineral fibers of the present invention.

FIG. 3 shows a multiple strand package having square edges and layer on layer accumulation of the strands. The strands wound onto the package have the LOI in the range of about 0.1 to about 3 weight percent and the moisture content in the range of at least about 3 weight percent. The strands in each layer are arranged in an ungrouped arrangement for the majority of each layer as is possible where the strands are laid in side-by-side configuration or a wavy and crossing configuration to each other in the layer. It is also possible that the package with the square edges has a slight concave appearance in viewing the package longitudinally and perpendicular to the central axis of the package. Such a package is that having a dog-boned shape. The layers of the package as indicated in FIG. 3 at numeral 56 are not disposed across the layer in any grouped or bundled arrangement of the strands for the majority of the length of the layer. The strands are in grouped arrangement at the ends of the package, 58, to give the square edges to the package.

The package 24 is covered with a substantially water impervious, sealable covering, 60. The covering completely-surrounds the package and is sealed at 62 to keep the moisture present in the package from escaping beyond the covering. The covering can be one or more polymeric materials which are substantially water imperviable so that the covered package does not allow a decrease of the moisture on the strand below about 2 weight percent over the period of aging. Examples of such materials that can be used to cover package 60 include high molecular weight, high density polyethylene film in the form of a bag of 20 inches by 42 inches with 2 mils thickness available from National Packing Specialists, Mountainside, N.J., which is the preferred covering for the package. Additional non-exclusive examples include heat shrinkable films such as bi-axially oriented, crosslinked polyolefins, polyvinyl chloride, polyvinylidene chloride, polyacrylates, linear polyesters and polyamides. Other materials that are useful are those having a water vapor transmittance in grams per 24 hours per 1 square meter at 100° F. and 90% relative humidity according to ASTM E96 method E 1 of less than around 20 for a one mil (0.001 inch) thickness. This would include materials such as low density (0.910–0.25), medium density (0.926–0.940), and high density (0.941–0.965) polyethylene; polyester; polyester-saran-type coating; polybutylene; nylon cast saran-type coating; polypropylene oriented, unoriented, balanced, and oriented and stabilized; polyvinylidene chloride (saran); and vinyl and polyvinylchloride and their plasticized versions; nitrile barrier films; fluorohalocarbon; and lacquered, polymer coated and polyethylene coated cellophane. When the water vapor transmission is in the upper limit of the range, a thicker or multilayered covering can be used, but the thickness of a covering having a water vapor transmission of 8 to 15 is usually around 2 mils. The dimensions of the covering must be sufficient to allow for total wrapping or surrounding of the one or more packages and for sealing. The sealing can be accomplished by processes known to those skilled in the art such as: by mechanical or impulse means, or by the application or heat or adhesive or solvent, or by a heat shrinking process. When a heat shrinkable covering is used, a small hole can be cut into the covering to allow for the escape of air during heat shrinking, but the hole must be adequately sealed afterwards to retain the moisture of the package within the covering.

When the cylindrical, square edged package is removed from the winder, it can be placed directly into the covering and sealed or can be placed in an intermediate covering. The intermediate covering need not have the water impervious characteristics of the substantially water impervious covering. At a later time after quality control inspection and end finding, but preferably within 48 hours, the package is placed in the substantially water impervious covering and sealed. Also it is possible to place more than one cylindrical, square edged package in the substantially water impervious covering. Such a process would involve preliminarily covering the package after its production with an intermediate covering, then taking several packages with the intermediate covering or without the intermediate covering and placing them in the substantially water impervious cover and sealing the cover. This operation could be conducted with a pallet sized load of the cylindrical, square edged packages. The square edged packages can have lead strands from the inside of the package, like lead strand 64 or from the outside of the package such as lead strand 66. The package 60 with the central opening 52 can have the support tube removed so a lead strand is available for inside pulling. When the package is to be pulled from the outside the cardboard tube support should be left in the center of the package. When a cardboard tube support is left, it is preferred to have a ring such as 68 which slides onto the cardboard tube to present an outer edge to the package to prevent the strand from pulling across the tube, when the strand is paid out of the package from the outside. When the cardboard tube is present and as the package gets smaller, the payout angle is such that the glass would drag along the outer edge of the package and tube. With the ring in position, the glass has a smoother surface to ride along and consequently there is a reduction of the chance of break-outs. The ring can be made of any material such as aluminum, phenol formaldehyde, resorcinol formaldehyde, urea formaldehyde, melamine formaldehyde condensates and other polymeric materials to provide the smoother surface.

The cylindrical, square edged package sealed in the substantially water impervious covering is aged in the covering for a period of time. The aging is conducted at ambient temperature for a period of at least 2 weeks, where the ambient temperatures are in the range of from 50° F. (10° C.) to about 90° F. (32° C.). The period of two weeks at ambient temperatures gives an aged package that has good payout with an outside pull of the strand or strands from the package. A period of around four weeks at ambient temperatures is required to have good payout for an aged package to be paid out from the inside. When aging packages that are to be paid out from the outside, a period of three months at ambient temperatures should not be exceeded. For aged packages to be paid out from the inside of the package, there is no limitation to the duration of aging at ambient temperatures. If temperatures above or below ambient are used for aging, then the period is equivalently shortened or lengthened respectively. The aging can also be conducted at elevated temperatures, which would shorten the period of residency of the package in the sealed covering. The sealed packages can be aged at conditions equivalent to about 48 hours at about 140° F. (60° C.), where higher temperatures would shorten the residence time further and lower elevated temperatures would increase the residence time. A temperature of around 212° F. (100° C.) should not be exceeded because the covered package may explode or because this would drive a lot of the moisture from the package of strand or strands into the environment within the covering, and the moisture may not resettle properly on the package of strand or strands when the covering is removed. When the strand is a strand having a peroxide present on the aqueous coating on the strand, elevated temperatures above the decomposition temperature of the peroxide should not be exceeded because such action would induce the production of free radicals limiting the effectiveness of the peroxide for later use in the reinforcement of polymeric materials. Even with the peroxide containing strand, the time of aging for the package to be paid out from the inside of the package can be any length of time at ambient temperatures. For example, times as long as two years or more can be utilized. The aging can be conducted in any storage facility, when ambient temperatures are used, and even in cold storage areas for periods as long as 6 months, where the temperature can be around 38° F. (3.3° C.) When elevated temperatures are used, any conventional forced air or other type of oven or heater can be used. The packages can be aged during transit at ambient temperatures, even if the transit takes up to two years. The strands that will be removed from the aged package will still be wet and have improved payout from the interaction of the components within the sizing composition including the water.

The aged package has good storability and can be stored at temperatures varying in the range of about −20° F. (−29° C.) to around 120° F. (50° C.). So the aged packages are suitable for being shipped and stored in hot or cold railway cars, trailers, ships and warehouses in order that the aged packages can be used at a location remote from the location of their production. After shipping and storage, the aged packages have good strand payout and the strands do not have less than 2 weight percent moisture. Such a moist strand is ideal for producing continuous strand mat.

Figure 4:
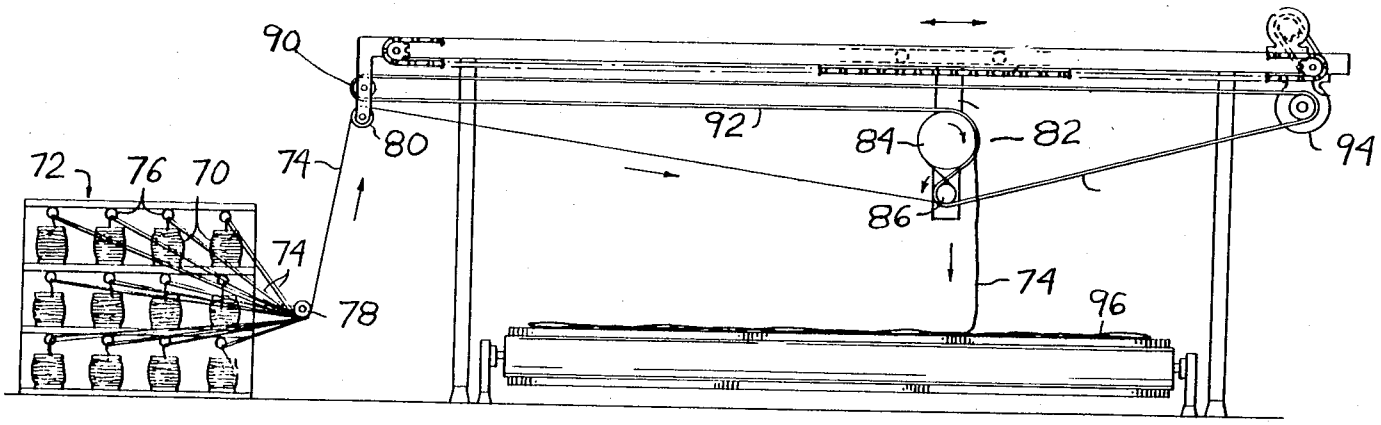
FIG. 4 is a schematic, longitudinal, end elevational view of a mat forming operation using packages of the shippable wet strand of sized mineral fibers of the present invention.

When the packages have been aged sufficiently, a plurality of the packages are used to produce continuous strand mat as shown in FIG. 4. FIG. 4 illustrates the production of continuous strand mat from the aged packages with the substantially water impervious covering having been removed. The covering can be removed in any fashion known to those skilled in the art for removing items from sealed films. The aged packages 70 of strands are located on creel 72. The strands 74 are removed from each package and are passed through strand guides 76 for each package and through guide bar 78. Here the strands 74 may be combined into one or more larger strands. Preferably, however, the strands remain as separate strands and pass to driven roller 80 in a generally parallel path. The strands removed from the aged packages are wet and have improved payout from the packages into the driven roller with fewer break-outs than unaged packages. The wet strands at this point in the process of producing continuous strand mat reduce the possibility of static build up and provide cohesive force with wheels 84 and 86 of attenuator 82 to advance the strands in any of numerous manners known to those skilled in the art. It may be desirable to add additional amounts of anti-static materials to the strands between the creel and the attenuator to further reduce the production of any static. A suitable anti-static material is Triton X-100, which is a nonionic isooctyl phenyl polyethoxy ethanol surfactant.

The wheels in the attenuator can be connected in any manner known to those skilled in the art to drive and to reciprocate the attenuator to deposit the continuous strand onto the moving conveyor 88. For instance, wheels 90, 84 and 86 of attenuator 82 can be connected through an endless belt 92 to a constant speed motor 94 to drive the wheels of the attenuator. Methods of reciprocating the attenuator are discussed in U.S. Pat. No. 4,158,557 (Drummond), hereby incorporated by reference, but any other method of reciprocating a feeding device known to those skilled in the art can also be used.

The continuous strand mat prepared from the aged glass fiber strand and/or strands having an improved payout from the aged packages and having a reduced content of film forming polymer of about 50% in the size on the fibers and strands can be used to reinforce polymeric materials to yield substantially similar physical properties as polymeric materials reinforced with glass fibers having a sizing composition with the standard amount of film forming material. Also, the continous strand mat can be needled before being used to reinforce polymeric materials. The process of needling can be that known to those skilled in the art and that discussed in U.S. Pat. No. 4,158,557, already incorporated by reference and that discussed in U.S. Pat. 4,277,531 (Picone), hereby incorporated by reference.

PREFERRED EMBODIMENT

The glass fibers are used to produce the aged, cylindrical, square edged multistrand packages, where the glass fibers are E glass fiber strands and where they are formed to have a fiber diameter of a T fiber, $9.50 \pm 0.25 \times 10^{-4}$ inch (27 microns). The T fibers are attenuated and sized with the aqueous sizing composition having polyvinyl acetate film former, vinyl silane coupling agent, surfactants and emulsifiers and a heat stable organic peroxide as disclosed in U.S. Pat No. 3,948,148, but where the amount of polvinyl acetate has been reduced by 50 weight percent. The fibers can be gathered to form 2, 4 or 7 strands, but preferably 2 strands are formed having a construction of T11.5 2/S from a 400 filament bushing. The water content of the aqueous sizing composition is about 95 to about 97 weight percent, where the sizing composition is the formulation of Example II. The water used for preparing the aqueous sizing composition is preferably deionized water. The sized, gathered strands are wound into the cylindrical, square edged package at a winder speed of around 3200 feet per minute. The tension on the strand should not be below 250 grams. The layer on layer package is built up until the package has a outside diameter of 10 inches and an inside diameter of about 5 inches and a weight of about 30 to 45 pounds. The moisture content of the strand produced at this speed with the use of the particular sizing composition is around 4 to 10 weight percent of the strand and the amount of sizing on the strand measured in LOI is around 0.1 to about 0.8 weight percent.

The cylindrical, square edged package is removed from the winder and placed in an intermediate covering, which is sealed by mechanical means. After a time the strand packages are removed from the covering and the the packages are inspected and the supporting tubes are removed and the inner and outer ends of the strands are found. The packages are placed in the substantially water imperviable covering, which is also sealed mechanically. The water imperviable covering is a high molecular, high density polyethylene, 2 mils in thickness and preferably of a size to contain one cylindrical, square edged package per covering in the form of a bag about 20 inches by 42 inches. The bags are preferably aged for about 6 to about 8 weeks at ambient conditions of preferably 60° F. (16° C.) to 80° F. (27° C.). The packages are removed from the bag covering to be combined with other packages to be paid out from an inside pull to produce continuous strand mat, which is preferably needled for polymeric reinforcement.

The present invention is further illustrated by the following nonlimiting examples.

EXAMPLES I and II

Two aqueous sizing compositions were prepared for treating glass fibers. The formulations of the treating compositions are given in Table I below.

TABLE I

| COMPONENT | EXAMPLE I AMOUNT | EXAMPLE II AMOUNT |
|---|---|---|
| Total water for aqueous composition | 378.54 liters | 126 liters |
| Heat stable peroxide (Vul-Cup R peroxide available from Hercules Chemical Co.) | 12.92 kilograms | 2.59 kilograms |
| Nonionic surfactant (Triton X-100 isooctyl phenyl polyethoxy ethanol) | 1.72 kilograms | 344.8 grams |
| Cationic lubricants (Emery 6717 available from Emery Chemical Co.) | 0.143 grams | 28.68 grams |
| Water for lubricant | 1.89 grams | |
| Vinyl silane coupling agent (A-172 available from Union Carbide Co.) | 21.8 grams | 4.368 grams |
| Polyvinyl acetate (NS 25-1031 available from National Starch & Chemical Co.) | 5.74 grams | 1.15 grams |
| Acetic acid | 0.86 grams | 1.72 grams |

The aqueous sizing composition of Example I was prepared by using deionized water in the following manner. One fourth of the total amount of water was added cold to a main mix tank and agitation was begun. The listed amount of acetic acid was added to the vigorously agitated water in the main mix tank. Hot water at about 140° to 160° F. (60° to 71° C.) was added to a premix vessel and the cationic lubricant was added to this water with agitation for around 15 minutes. The recited amount of vinyl silane was added to the main mix tank and agitated for 20 minutes. Afterwards, the water lubricant solution was added to the main mix tank. The requisite amount of polyvinyl acetate was added to the main mix tank. The amount of surfactant was added to an Eppenbach tank and the specified amount of peroxide, which had been melted at a temperature of 150° F., was added to the Eppenbach tank. The surfactant and peroxide were blended for 1 minute with the plate in the upper position. The plate was then lowered and the surfactant and peroxide mixture was emulsified using hot water (140° to 160° F.) until inversion occurred. The hot water was added at a rate of between 1 and 1.5 grams per minute. After the inversion, an amount of cold water was added to the Eppenbach tank and the mixing continued for five minutes at a temperature below 120° F. The amount of cold water added is 1/25 of the total volume of the aqueous treating composition. Additional cold water can be added to decrease the emulsion temperature, if necessary. The peroxide emulsion was pumped into the main mix tank and the aqueous sizing composition was diluted to final volume using cold water and was mixed for five minutes.

The aqueous sizing composition of Example II was prepared in a similar manner.

The total solids of the aqueous sizing composition of Example I was 3.9±0.2 and the total solids of Example II was 4.2.

The aqueous sizing composition of Example I and II were used to prepare continuous glass fiber strands in a direct draw roving process to produce a cylindrical, square edged package having multiple strands, where the strand construction was a T-11.5 2/S prepared from a 400 filament bushing to give two strands in the package. The applicator speed of around 55 rpms was adjusted to obtain the correct percent LOI and percent moisture at nominal binder solids for good package build. The aqueous treating composition of Example II was used in two runs to produce the cylindrical, square edged package. In the first run, the linear pulling speed was 3278 feet per minute. The package was an 8.18 waywind, where a waywind is the number of rotations of the winder to complete one traverse of the winder by the strand or strands. The tension on the strand was around 200 to 400 grams and preferably 275 grams as a single strand, at least about 400 grams for both strands. The package produced had a length of 12 inches, an outside diameter of 9.5 inches and an inner diameter of 5⅛ inches and a weight of 45±5 pounds. The LOI of the strand was in the range of 0.31 percent to 0.71 percent and the moisture of the package was in the range of 2.7 percent to about 9.2 percent.

The second run using the aqueous sizing composition of Example II was produced with a winder linear pulling speed of 3836 feet per minute. The tension on the strand was 200 grams for the 2/S strands and on the single filaments, it was at least 400 grams per both strands. The aqueous treating composition was applied at an applicator speed of around 87 rpms for a roll type applicator. The waywind of the strand into the package was 8./8 and the package produced had an outside diameter of 9½ inches and an inner diameter of 5⅛ inches and a package weight of 39.5±5 pounds and a length of 12 inches ±¼ inch. The LOI on the strands in the package was 0.55±0.15%, where the strands were constructed of 400 filaments having a filament diameter of 0.0009 inch to 0.000949 inch. The moisture content of the package was from about 3 to about 9 weight percent.

A cylindrical, square edged package utilizing the aqueous sizing composition of Example I would be prepared in the same manner as that for the aqueous treating composition of Example II.

After the packages were produced, they were removed from the winders and placed in individual intermediate polyethylene bags to reduce moisture loss until the package could be inspected for quality control and end found. For this the packages were removed from the bags inspected and end found and then placed into the substantially water impervious bags which were high molecular weight, high density polyethylene bags 20 inches by 42 inches and 2 mils thick. The bags were tied to seal the bag around each of the cylindrical, square edged packages.

A plurality of the packages produced with the aqueous treating composition of Example I and Example II were aged at varying temperatures for varying amounts of time. One set of packages produced with the aqueous treating composition of Example II were aged for 30 days at ambient temperatures of around 10° to 30° C. These packages were used to produce continuous glass fiber strand mat by placing the packages in a creel and paying out the packages into a continuous glass fiber strand mat line similar to that discussed for FIG. 4. In 5 runs at making continuous glass fiber strand mat, the improved payout of the strands from the packages was noted as is shown from the data of Table II. These data show the low number of breaks, roll wraps and belt wraps indicating good payout of the strands from the aged packages.

TABLE II

| Run # | Start/Stop Time | Type & Number of Break | Roll Wraps | Belt Wraps |
|---|---|---|---|---|
| 1 | 0852–0902 | Loop around other strand-2 | 0 | 0 |
| 2 | 0935–1006 | Loop around other strand-1 | 4 | |
| 3 | 1006–1017 | Lost end-1 | 3 | 1 |
| 4 | 1049–1059 | Lost end-1 | — | 0 |
| | | Trapped end-1 | — | — |
| | | Slough-1 | 4 | 0 |
| 5 | 1114–1130 | Trapped end-1 | — | — |
| | | Loop around other strand-1 | 1 | 0 |

Multistrand packages produced by direct draw utilizing the aqueous treating composition of Example I and Example II were aged for 11 to 13 weeks at ambient temperatures ranging from about 0° F. to 80° F. (−18° C. to 27° C.--. in high molecular weight, high density polyethylene bags. The payout data of minimal belt wraps, creel breaks and sloughs for these packages is given in Table III.

TABLE III

| | Belt Wraps/Feeder/Hr Creel Breaks/ Feeder/Hr | Minor Sloughs that went through feeders with no problems/feeder/hr |
|---|---|---|
| 24-lb Pkgs T-11.5 2/S Example 2 | 0.59 0.00 | 2.14 |
| 37.5-lb Pkgs T-11.5 2/S Example 2 | 0.00 2.35 | 2.35 |
| 7.5-lb Pkgs T-11.5 2/S Example 1 | 3.14 8.77 | 32.85 |

Aged packages having multiple strands were produced utilizing the aqueous treating composition of Example II in a direct drawing process. These packages were stored at different temperatures for different periods of time as shown in Table III. The aging was performed at varying temperatures for at least 6 weeks for all of the packages. The characteristics of the strand and the good payout after storage are noted in Table IV.

TABLE IV

| | Strand Integrity | Strand Break | Package Payout | % LOI | PEROXIDE | % $H_2O$ |
|---|---|---|---|---|---|---|
| | | Storage Temperature - 130° F. (54° C.) | | | | |
| Pkg. Aged 1 month | Good | 50 | Excellent | .49 | .169 | Not Available |
| Pkg. Aged 3 months | Fair | 100 | Fair | .73 | .167 | NA |
| Pkg. Aged 6 months | Poor | 100 | Poor | .56 | 127 | 0.750 |
| | | Storage Temperature - 70–80° F. (21–27° C.) | | | | |
| Pkg. Aged 1 month | Good | 50 | Excellent | .58 | .212 | 6.73 |
| Pkg. Aged 3 months | Good | 75 | Excellent | .76 | .167 | NA |
| Pkg. Aged 6 months | Fair | 75 | Excellent | .72 | .125 | 2.50 |
| | | Storage Temperature - −5° F. (−21° C.) | | | | |
| Pkg. Aged 1 month | Good | 50 | Excellent | .54 | .217 | NA |
| Pkg. Aged 3 months | Good | 50 | Excellent | .52 | .188 | NA |
| Pkg. Aged 6 months | Good | 50 | Excellent | .64 | .165 | 2.55 |

The foregoing has disclosed a cylindrical, square edged package of one or more strands having improved payout for the production of continuous strand products. The product is a shippable package of strand which, when arriving at its destination, can be used as a wet strand having a moisture content of at least around 3 weight percent and preferably between 3 and about 12 weight percent. The package is placed in a substantially water impervious covering, which is sealed to age the package in the moisture environment produced by the package for a period of at least two weeks at ambient temperature or 48 hours at elevated temperatures. The process of producing the package involves drawing glass fibers strands and treating them with an aqueous solution having a film forming material and an amount of water in the range of about 70 to about 99 weight percent of the treating composition and combining the filaments into one or more strands and winding the strand at a speed to produce a package having a moisture content of 3 weight percent or greater and preferably 3 to around 12 weight percent. The packages are then placed and sealed in a substantially water impervious covering for aging.

I claim:

1. A shippable, covered cylindrical package of one or more sized glass fiber strands to provide wet, continuous glass fiber strand with improved payout from the cylindrical package, comprising:

(a) a plurality of layers having substantially equal length, each layer having one or more continuous strands of glass fibers drawn from a source of molten fiberizable glass, said glass fibers during their formation are treated with an aqueous treating composition to provide a coating on a substantial portion of their surfaces, said coating comprising water and a film forming material, wherein water is present in an amount of about 70 to around 99 weight percent of the treating composition and the film forming material is present in an amount to give a coating having about 0.1 to about 3 weight percent LOI and where the strands in the package have a moisture content in the range of at least around 3 weight percent to about 12 weight percent of the strand, and (b) a substantially impervious covering completely sealed around the plurality of layers of strand or strands of coated glass fibers said strand or strands being aged for a time and at a temperature equivalent of at least about two weeks at ambient temperature, said moisture content of the strands being maintained above about 2 weight percent so that the moisture and film forming material cooperate to result in improved payout of the strands from the layers of the package.

2. Package of claim 1, wherein the substantially water impervious covering has a water vapor transmission less than 20 grams per 24 hours per 1 square meter at 100° F., 90% relative humidity for a 1 mil thickness of the covering.

3. Package of claim 1, wherein the covering is a high molecular weight, high density polyethylene film with at least two mil thickness.

4. Package of claim 1, wherein the covering is a plurality of coverings to achieve a water vapor transmission of less than 20 grams per 24 hours per 1 square meter at 100° F., 90% relative humidity for a 1 mil thickness of the covering.

5. Package of claim 1, wherein the number of strands in the package ranges from 2 to about 12.

6. Package of claim 1, wherein the aqueous treating composition present on the strands has in addition to the water content of about 70 to around 99 weight percent of the treating composition and the film forming material, one or more lubricants, and one or more plasticizers.

7. Package of claim 1, wherein the aqueous treating composition has present a polyvinyl acetate film forming material.

8. Package of claim 7, wherein the aqueous treating composition also has a heat stable peroxide, vinyl containing coupling agent, surfactant and glass fiber lubricant.

9. Package of claim 8 that has been aged no longer than 3 months at ambient temperatures for an outside pull of the strand or strands from the package, which has a tubular support on which the one or more strands are wound.

10. Package of claim 9 having a ring inserted in the tubular support member.

11. Package of claim 8 that has been aged for at least 4 weeks at ambient temperatures for an inside pull of the strand or strands from the cylindrical package.

12. Process for producing a shippable, wet, multistrand package of glass fiber strands, comprising:

(a) drawing a plurality of glass fibers from a source of molten fiberizable glass, (b) treating the glass fibers with an aqueous treating composition having a film forming material to form a coating over a substantial portion of the surface of the glass fibers, where the treating composition has a water content of about 70 to around 99 weight percent of the treating composition and an amount of film forming material to give a coating with about 0.1 to about 3 weight percent LOI, (c) collecting the treated glass fibers into one or more strands, (d) winding the one or more strands into a cylindrical package with nearly square edges and flat annular surfaces so that the strands placed into the package can be removed from the package with a split efficiency of around 70 to around 100 percent, where the strands in the package have a moisture content of at least 3 weight percent, (e) placing one or more of the packages in one or more coverings that are substantially impervious to water, (f) sealing the one or more coverings to completely surround the one or more packages, (g) aging the sealed packages for around at least 2 weeks at ambient temperatures which vary from about 50° F. to about 90° F. (about 10° C. to about 32° C.) where the one or more coverings maintain a moisture content on the strand of above about 2 weight percent so that the moisture and film forming material cooperate to result in improved payout of the strands from the layers of the package.

13. Process of claim 12, wherein the amount of moisture on the strand is in the range of at least about 3 to about 12 weight percent of the strand.

14. Process of claim 12, wherein film forming material is polyvinylacetate present in the amount in the range of about 0.25 to about 2.5 weight percent of the aqueous treating composition.

15. Process of claim 14, wherein the aqueous treating composition also has a heat stable peroxide, vinyl containing coupling agent, surfactant and glass fiber lubricant.

16. Process of claim 12, wherein the cylindrical, square edged package of strand is placed in an intermediate covering having more water permeability than the covering that is substantially impervious to water before the packages are placed in the covering that is substantially impervious to water and sealed.

17. Process of claim 12, wherein the aging is at a time of at least 48 hours at a temperature around 140° F. (60° C.).

18. Process of claim 12, wherein the substantially water impervious covering ia a 2 mil thick film of high density, high molecular weight polyethylene.

19. Covered package of glass fiber strands produced by the process of claim 12.

20. Process of producing a continuous strand mat from wet glass fiber strands produced at a remote location from the location of production of the mat, comprising:

(a) forming a plurality of glass fibers from a source of molten fiberizable glass, (b) treating the glass fibers with an aqueous treating composition having a film forming material to form a coating over a substantial portion of the surfaces of the glass fibers where the treating composition has an amount of water to about 70 to around 99 weight percent of the composition, and wherein the amount of film forming material gives a coating having about 0.1 to about 3 weight percent LOI, (c) gathering the fibers into one or more strands, (d) winding the strands into a cylindrical, layered package with substantially square edges and two flat surfaces, where each layer has one or more strands wound in non-grouped relation to each other for a substantial portion of the layer where the strands have a moisture content of at least around 3 weight percent of the strand, (e) aging one or more cylindrical, layered packages of glass fiber strand or strands with the moisture content of at least around 3 weight percent of the strand in one or more coverings that are substantially impervious to water that completely surrounds the one or more packages to seal the moisture for a time of at least about 2 weeks at ambient temperatures of around 50° F. to around 90° F. (around 10° C. to around 32° C.) so that after aging the amount of moisture on the strand is not less than around 2 weight percent so that the moisture and film forming material cooperate to result in an improved payout of the strands from the layers of the package.

21. Package of claim 1, wherein film forming material is polyvinylacetate present in the amount in the range of about 0.25 to about 2.5 weight percent of the aqueous treating composition.

22. Package of claim 1, wherein the aqueous treating composition also has a heat stable peroxide, vinyl containing coupling agent, surfactant and glass fiber lubricant.

23. Package of claim 1, wherein the substantially impervious covering is sealed through heat shrinking.

24. Package of claim 1, wherein the substantially impervious covering is sealed mechanically.

25. Package of claim 1, wherein a reduced amount of the film forming material is used.

* * * * *